US010170086B2

(12) United States Patent
Taguchi

(10) Patent No.: US 10,170,086 B2
(45) Date of Patent: Jan. 1, 2019

(54) SUPPORT DEVICE FOR PIVOTAL MEMBER OF KEYBOARD INSTRUMENT AND METHOD OF MANUFACTURING THE SAME

(71) Applicant: KABUSHIKI KAISHA KAWAI GAKKI SEISAKUSHO, Hamamatsu-shi, Shizuoka-ken (JP)

(72) Inventor: Takaaki Taguchi, Hamamatsu (JP)

(73) Assignee: Kabushiki Kaisha Kawai Gakki Seisakusho, Hamamatsu-shi, Shizuoka (JP)

( * ) Notice: Subject to any disclaimer, the term of this patent is extended or adjusted under 35 U.S.C. 154(b) by 0 days.

(21) Appl. No.: 15/478,044

(22) Filed: Apr. 3, 2017

(65) Prior Publication Data

US 2017/0301321 A1 Oct. 19, 2017

(30) Foreign Application Priority Data

Apr. 13, 2016 (JP) ..... 2016-080178

(51) Int. Cl.
*G10C 3/18* (2006.01)
*G10C 3/16* (2006.01)

(52) U.S. Cl.
CPC ..... *G10C 3/18* (2013.01); *G10C 3/161* (2013.01)

(58) Field of Classification Search
CPC ..... G10C 3/18; G10C 3/161
See application file for complete search history.

(56) References Cited

U.S. PATENT DOCUMENTS 1,823,142 A * 9/1931 Hickman ..... G10C 3/22 84/239
2,580,438 A * 1/1952 Knoblaugh ..... G10C 3/16 29/898.07
3,523,080 A * 8/1970 Delaplace ..... F16C 33/04 427/389.9
3,730,963 A * 5/1973 Imagawa ..... G10C 3/16 84/251
3,859,885 A * 1/1975 Hayashida ..... F16C 23/04 384/300

(Continued)

FOREIGN PATENT DOCUMENTS

JP 60-30490 3/1985

*Primary Examiner* — Robert W Horn
(74) *Attorney, Agent, or Firm* — Lewis Roca Rothgerber Christie LLP

(57) ABSTRACT

A support device for a pivotal member of a keyboard instrument, in which opposite ends of a pivotal pin fixed to a pivotal member can be each properly positioned in the center of a pin hole, to thereby enable the pivotal member to perform efficient and stable pivotal motion. The support device that pivotally supports the pivotal member pivotally moved by key depression includes a flange body including two support walls opposed to each other with a predetermined spacing therebetween, and two pin holes which are formed in the respective support walls and in which opposite ends of the pivotal pin are inserted, respectively, and two bearings fixed in the pin holes in an inserted state and having opposite ends of the pivotal pin inserted therein, for pivotally supporting the pivotal. Each bearing is formed by a braid formed in a hollow cylindrical shape.

2 Claims, 9 Drawing Sheets

(56) References Cited

U.S. PATENT DOCUMENTS

| | | | | |
|---|---|---|---|---|
| 4,673,515 | A * | 6/1987 | Sakai | G10C 3/16<br>508/100 |
| 5,299,484 | A * | 4/1994 | Ishida | G10C 3/16<br>84/251 |
| 7,459,616 | B2 * | 12/2008 | Yoshisue | G10C 3/18<br>84/251 |
| 8,735,700 | B2 * | 5/2014 | Abe | G10C 3/18<br>84/243 |
| 2017/0301321 | A1 * | 10/2017 | Taguchi | G10C 3/18 |

* cited by examiner

SUPPORT DEVICE FOR PIVOTAL MEMBER OF KEYBOARD INSTRUMENT AND METHOD OF MANUFACTURING THE SAME

CROSS-REFERENCE TO RELATED APPLICATION(S)

This application claims priority of Japanese Patent Application Number 080178/2016, filed on Apr. 13, 2016, the entire content of which is incorporated herein by reference.

BACKGROUND OF THE INVENTION

Field of the Invention

The present invention relates to a support device for a pivotal member of a keyboard instrument, which is applied e.g. to an action of an acoustic piano and configured to pivotally support the pivotal member pivotally moved by key depression, and a method of manufacturing the support device.

Description of the Related Art

In general, an acoustic piano is provided with actions each of which operates in accordance with key depression to drive an associated hammer. The action has a plurality of components pivotally moved by key depression, such as a wippen and a jack (each of the components including a hammer will be hereinafter referred to as "a pivotal member" as deemed appropriate), and each of the pivotal members is pivotally supported by an associated flange via a pivotal pin fixed to the pivotal member.

FIG. 7A shows an example of a flange for supporting a pivotal member. As shown in FIG. 7A, the flange 41 has an upper portion thereof bifurcated into two support walls 41*a* and 41*a* opposed to each other with a spacing therebetween. The two support walls 41*a* and 41*a* are formed with respective pin holes 41*b* and 41*b* each extending through the associated support wall 41*a*, and a bushing cloth 42 as a bearing is mounted in each of the pin holes 41*b* and 41*b*, as shown in FIG. 7B, so as to suppress noise caused by contact with a pivotal pin 44. As the flange 41 having the bushing cloth 42 mentioned above, there has conventionally been known one disclosed in Japanese Laid-Open Utility Model Publication (Kokai) No. S60-30490. In this conventional flange 41, the bushing cloth 42 is mounted in the pin holes 41*b* and 4*b* in a manner described below.

FIGS. 8A to 8D illustrate a procedure in which the bushing cloth is mounted in the flange 41. First, a cloth 43 made of wool or a synthetic resin is prepared, as shown in FIG. 8A. Next, the cloth 43 is cut into a strip having a predetermined width, as shown in FIG. 8B, whereby a strip-shaped cloth 43*a* is made. Then, the strip-shaped cloth 43*a* is inserted through the two pin holes 41*b* and 41*b* while being rolled up into a cylindrical shape, as shown in FIG. 8C, and is bonded to inner surfaces of the respective pin holes 41*b* and 41*b*. Finally, the cylindrical cloth 43*a* is cut along outer and inner surfaces of each of the support walls 41*a* of the flange 41. This mounts the cylindrical bushing cloths 42 and 42 in the two pin holes 41*b* and 41*b* of the flange 41, respectively, as shown in FIG. 8D.

Note that a pivotal member is mounted between the two support walls 41*a* and 41*a* of the flange 41 constructed as above, and the pivotal pin 44 is inserted through the two pin holes 41*b* and 41*b* and the pivotal member. Thus, opposite ends of the pivotal pin 44 are supported by the pin holes 41*b* and 41*b* via the respective bushing cloths 42 and 42, whereby the pivotal member is pivotally supported by the flange 41.

In the above-described conventional flange 41, when the bushing cloth 42 is properly mounted in the pin hole 41*b* of the flange 41, a perfect circle is formed by the bushing cloth 42 inside the pin hole 41*b* as shown in FIG. 9A. However, if the circumferential length of the bushing cloth 42 is shorter (see FIG. 9B) or longer (see FIG. 9C) than that of the pin hole 41*b*, a gap can be formed at a joint of the bushing cloth 42 or the inner circle of the bushing cloth 42 can be deformed. In these cases, each of the opposite ends of the pivotal pin 44 deviates from the center of the associated pin hole 41*b* of the flange 41, and therefore loads applied to the pivotal pin 44 from the respective bushing cloths 42 are made nonuniform, which prevents the pivotal member from performing efficient and stable pivotal motion.

SUMMARY OF THE INVENTION

It is an object of the present invention to provide a support device for a pivotal member of a keyboard instrument, which makes it possible to properly position opposite ends of a pivotal pin fixed to a pivotal member, each in the center of an associated pin hole, to thereby enable the pivotal member to perform efficient and stable pivotal motion.

To attain the above object, in a first aspect of the present invention, there is provided a support device for a pivotal member of a keyboard instrument, which pivotally supports the pivotal member pivotally moved by key depression, via a pivotal pin fixed to the pivotal member, comprising a support device body including two support walls opposed to each other with a predetermined spacing therebetween, and two pin holes which are formed in the respective support walls and in which opposite ends of the pivotal pin are inserted, respectively, and two bearings which are fixed in the respective pin holes in a state inserted therein and have the opposite ends of the pivotal pin inserted therein, the two bearings pivotally supporting the pivotal pin, wherein each of the two bearings is formed by a braid formed in a hollow cylindrical shape.

With this construction of the support device, the pivotal member pivotally moved by key depression is supported by the support device via the pivotal pin fixed to the pivotal member. The support device body of this support device has the two support walls opposed to each other with a predetermined spacing therebetween, and the two pin holes in which the opposite ends of the pivotal pin are inserted are formed in the respective support walls. Further, the two bearings are fixed in the respective pin holes in a state inserted therein, and the pivotal pin is pivotally supported by the two bearings in which the respective opposite ends of the pivotal pin are inserted. Each of the two bearings for thus holding the pivotal pin is formed by a braid formed in a hollow cylindrical shape.

A braid is generally formed by knitting a plurality of fibers along a length thereof such that the fibers obliquely cross each other, and can be formed into a hollow cylindrical shape having a hollow extending over the whole length thereof. Therefore, by adopting such a braid as a bearing, it is possible to more easily obtain a bearing that has a proper hollow therein and allows insertion of an end of the pivotal pin in the central portion thereof, than in the related art in which a strip-shaped cloth is rolled up into a bushing cloth. This makes it possible to properly position the opposite ends of the pivotal pin fixed to the pivotal member in the center of the respective pin holes of the support device body, to thereby enable the pivotal member to perform efficient and stable pivotal motion.

Preferably, the braid is formed of fluoride fibers.

With the construction of this preferred embodiment, the braid formed of fluoride fibers, which generally have high lubricity and wear resistance, is employed as a bearing, and hence it is possible to reduce a frictional force generated between the pivotal pin and the bearings. This makes it possible to maintain smooth pivotal motion of the pivotal member having the pivotal pin fixed thereto, over a long term.

To attain the above object, in a second aspect of the present invention, there is provided a method of manufacturing a support device for a pivotal member of a keyboard instrument, which pivotally supports the pivotal member pivotally moved by key depression, via a pivotal pin fixed to the pivotal member, the method comprising a core material-containing braid-preparing step of preparing a core material-containing braid formed by a slender elongated core material and a braid extending along a length of the core material and covering a peripheral surface of the core material, a support device body-preparing step of preparing a support device body including two support walls opposed to each other with a predetermined spacing therebetween, and two pin holes which are formed in the respective support walls and in which opposite ends of the pivotal pin are inserted, respectively, a core material-containing braid-inserting and fixing step of inserting the prepared core material-containing braid through the two pin holes of the support device body and fixing the core material-containing braid to the support device body, a core material-containing braid-cutting step of cutting the core material-containing braid inserted through the two pin holes, along inner and outer surfaces of each of the support walls such that cut surfaces of the core material-containing braid become flush with the respective inner and outer surface, and a pivotal pin-mounting step of mounting the pivotal member between the two support walls of the support device body such that a hole portion of the pivotal member, through which the pivotal pin is to be inserted, and the pin holes of the two support walls are aligned in a straight line, and inserting the pivotal pin from outside one of the two support walls into the pin hole of the one of the two support walls, the hole portion of the pivotal member, and the pin hole of the other of the two support walls to thereby mount the pivotal pin while pushing out the core material of the core material-containing braid from each pin hole.

With this configuration, first, the core material-containing braid and the support device body are prepared. Then, the core material-containing braid is inserted through the two pin holes of the support device body and is fixed to the support device body. Then, the core material-containing braid inserted through the two pin holes is cut along the inner and outer surfaces of each of the support walls such that the cut surfaces of the core material-containing braid become flush with the respective inner and outer surface. This mounts a core material-containing braid having the same length as that of the support wall in each of the pin holes of the respective two support walls of the support device boy. Then, the pivotal member is mounted between the two support walls of the support device body such that the hole portion of the pivotal member, through which the pivotal pin is to be inserted, and the pin holes of the two support walls of the support device body are aligned in a straight line. Thereafter, the pivotal pin is inserted from outside one of the two support walls into the pin hole of the one of the two support walls, the hole portion of the pivotal member, and the pin hole of the other of the two support walls. In doing this, the pivotal pin is mounted while pushing the core material out of the core material-containing braid in each pin hole, using the pivotal pin being inserted. As a consequence, the opposite ends of the pivotal pin are inserted in the hollow cylindrical braids as bearings in the pin holes of the respective two support walls of the support device body. From the above, it is possible to easily manufacture and obtain the support device for a pivotal member of a keyboard instrument, according to the first aspect of the present invention.

Preferably, the pivotal member includes a plurality of kinds of pivotal members, and in the core material-containing braid-preparing step, a core material-containing braid in which the core material and the braid have respective predetermined diameters is prepared, while in the support device body-preparing step, the support device body has a diameter of the pin holes set according to a kind of the pivotal member to be supported thereby.

With the configuration of this preferred embodiment, a core material-containing braid formed by a core material and a braid having respective predetermined diameters is prepared, and the diameter of the pin holes of the support device body is set according to the kind of a pivotal member to be supported by the support device body. In this case, e.g. when a support device body is to support a pivotal member which should have a higher degree of rotatability, the diameter of the pin hole in the support device body is increased to thereby reduce friction of the braid as a bearing, which acts on the pivotal pin, whereby the degree of rotatability of the pivotal member can be made higher. On the other hand, when a support device body is to support a pivotal member which should have a lower degree of rotatability, the diameter of the pin hole in the support device body is reduced to thereby increase friction of the braid as a bearing, which acts on the pivotal pin, whereby the degree of rotatability of the pivotal member can be made lower. Therefore, even in a case where a core material-containing braid of a single type is used, it is possible to obtain a support device suitable for a degree of rotatability demanded of a pivotal member to be supported by the support device.

The above and other objects, features, and advantages of the present invention will become more apparent from the following detailed description taken in conjunction with the accompanying drawings.

BRIEF DESCRIPTION OF THE DRAWINGS

FIGS. 4A to 4C are views useful in explaining a method of manufacturing a flange, in which FIG. 4A is a perspective view of a core material-containing braid, FIG. 4B is a cross-sectional view of the core material-containing braid cut at right angles to the longitudinal direction thereof, and FIG. 4C is a perspective view of a flange body.

FIGS. 5A to 5C are views useful in explaining the method of manufacturing the flange, in which FIG. 5A is a perspective view showing a state in which the core material-containing braid has been inserted through respective pin holes of two support walls of the flange body, FIG. 5B is a perspective view showing a state in which the core material-containing braid inserted through the pin holes has been cut along the outer and inner surfaces of each of the support walls, and FIG. 5C is a cross-sectional view of the two support walls of the flange body in FIG. 5B.

FIGS. 6A to 6C are views useful in explaining the method of manufacturing the flange, in which FIG. 6A shows a state before mounting a pivotal member to the flange, FIG. 6B shows a state in which the pivotal member has been mounted between the two support walls of the flange, and FIG. 6C shows a state in which a center pin has been mounted in the flange and the pivotal member.

FIGS. 7A and 7B are perspective views of a conventional flange, in which FIG. 7A shows a state in which bushing cloths and a pivotal pin have been mounted, and FIG. 7B shows a state in which the bushing cloths and the pivotal pin have been removed.

FIGS. 9A to 9C are enlarged views of the bushing cloth mounted in a pin hole, in which FIG. 9A shows a state in which the bushing cloth has been properly mounted, FIG. 9B shows a state in which a gap has been formed at a joint of the bushing cloth, and FIG. 9C shows a state in which joint-forming ends of the bushing cloth have overlapped.

DETAILED DESCRIPTION OF PREFERRED EMBODIMENTS

Figure 1:
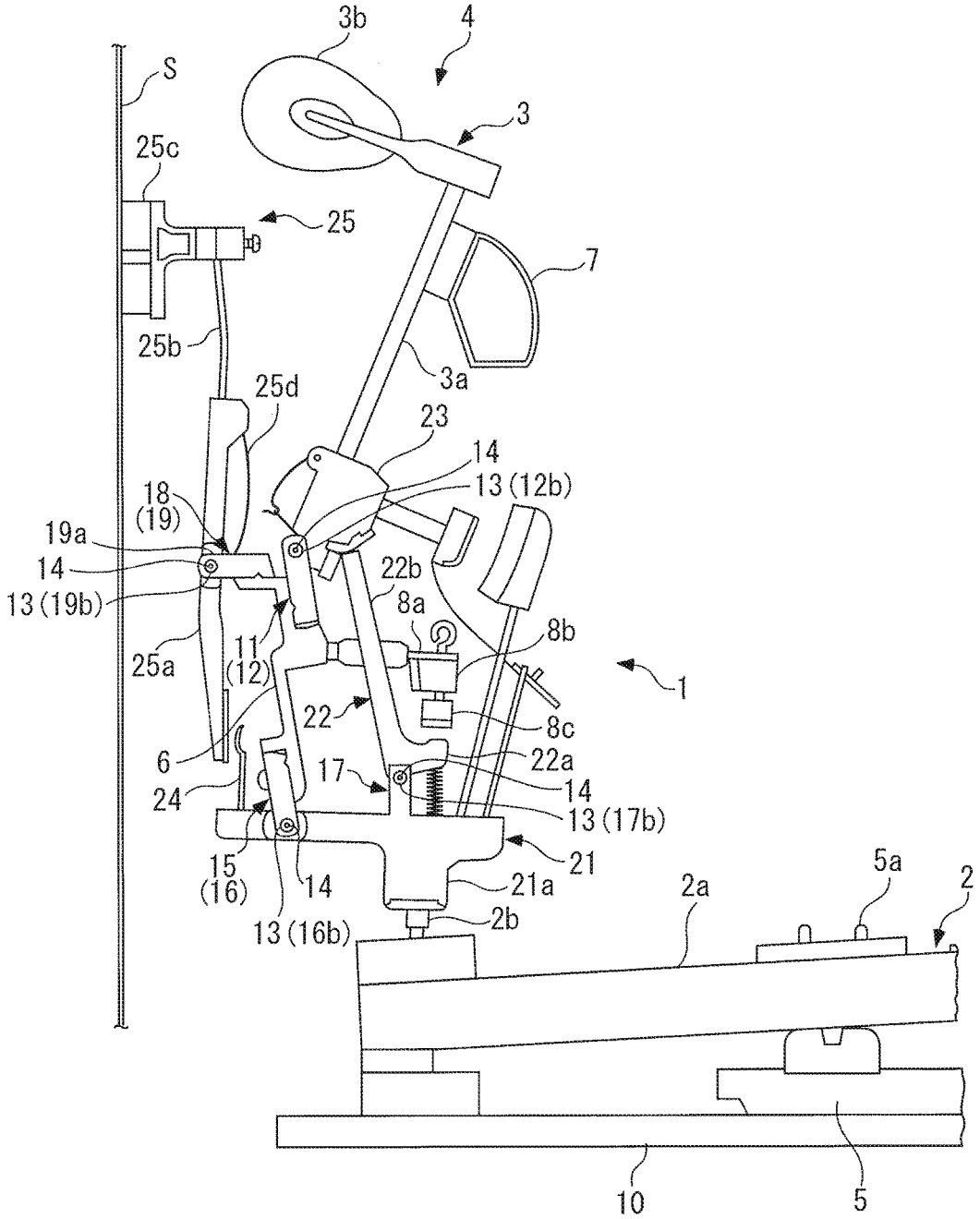
FIG. 1 is a side view of an action of an upright piano to which is applied a support device for a pivotal member, according to an embodiment of the present invention, and components around the action.

The present invention will now be described in detail with reference to the drawings showing a preferred embodiment thereof. FIG. 1 shows an action of an upright piano to which is applied a pivotal member support device according to an embodiment of the present invention, and components around the action. More specifically, FIG. 1 shows the action, denoted by reference numeral 1, a keyboard 2, a hammer assembly 4 (pivotal member) including a hammer 3, etc. in a key-released state. In the following description, a near side and a far side of the upright piano as viewed from a player (a right side and a left side as viewed in FIG. 1) will be referred to as "front" and "rear", respectively.

The keyboard 2 is comprised of a plurality of keys 2*a* (only one of which is shown in FIG. 1) arranged side by side in a left-right direction of the upright piano. Each of the keys 2*a* extends in a front-rear direction (left-right direction as viewed in FIG. 1), and is supported in a manner pivotally movable about a balance pin 5*a* erected on a keyframe 5 on a keybed 10.

Figure 2:
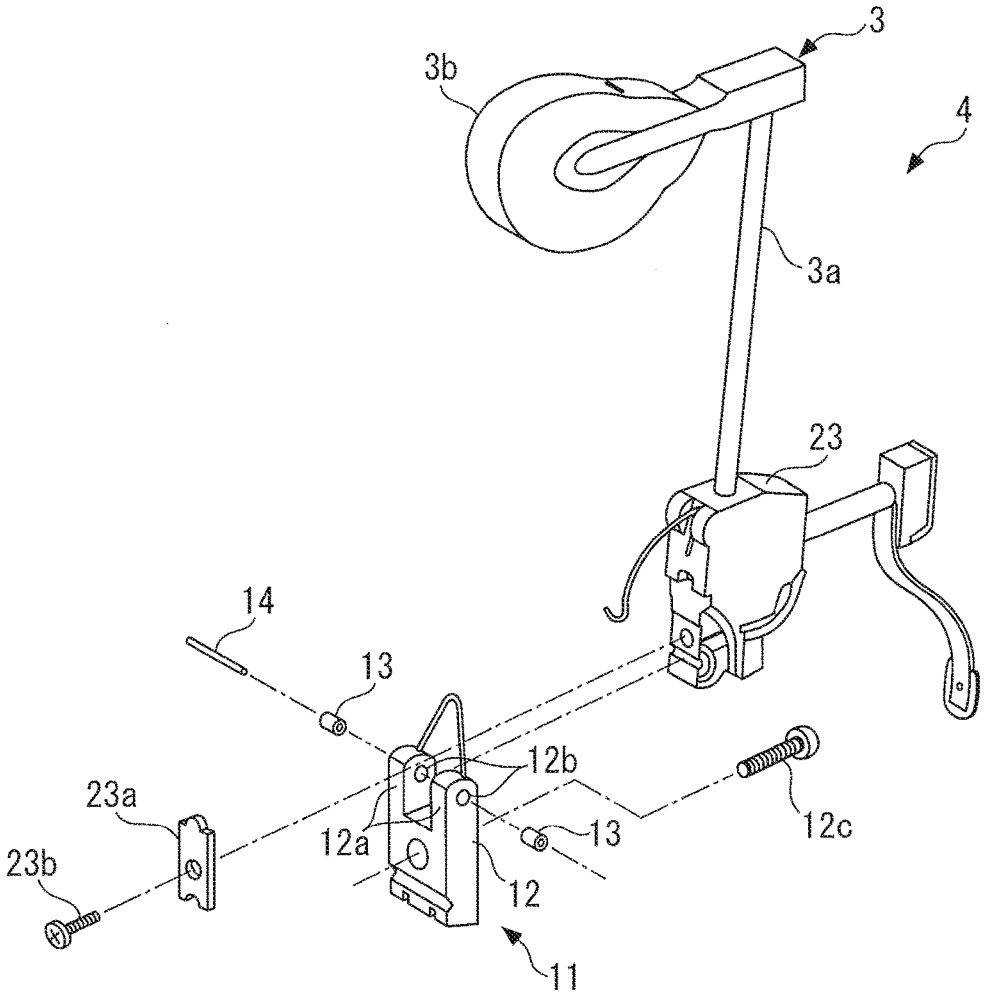
FIG. 2 is an exploded perspective view of a hammer assembly, a butt flange, etc. appearing in FIG. 1.

On each of left and right ends of the keybed 10, there is provided an action bracket (not shown), and the action 1 is disposed above the rear end of the keyboard 2 between the two action brackets. The action 1 includes a wippen 21 (pivotal member), a jack 22 (pivotal member), and a butt 23, and these components are provided in association with each key 2*a*. Further, as shown in FIG. 2, a hammer 3 comprised of a hammer shank 3*a* extending upward over a predetermined length and a hammer head 3*b* provided on the upper end of the hammer shank 3*a* is attached to the butt 23, and the hammer assembly 4 is formed by the butt 23, the hammer 3, and so forth.

Between the left and right action brackets, there are provided a center rail 6, a hammer rail 7, and so forth, in a manner extending in the left-right direction (depth direction as viewed in FIG. 1). A butt flange 11 for pivotally supporting the hammer assembly 4 via the butt 23 is fastened by a butt flange screw 12*c* (see FIG. 2) to the upper end of the front surface of the center rail 6, and is provided in association with each key 2*a*.

Each of the butt flanges 11 is comprised of a flange body 12 (support device body) and two bearings 13 mounted in two pin holes 12*b*, referred to hereinafter, of the flange body 12, respectively. The flange body 12 is made of a synthetic resin, and has an upper portion thereof bifurcated into two left and right support walls 12*a* and 12*a*. The two support walls 12*a* and 12*a* are opposed to each other with a predetermined spacing therebetween, and the pin holes 12*b* having a predetermined diameter are formed in the respective support walls 12*a* in a manner each extending through the associated support wall 12*a*.

Each of the bearings 13 is formed into a hollow cylindrical shape having substantially the same outer diameter as the diameter of the pin hole 12*b* and substantially the same inner diameter as the diameter of a center pin 14, referred to hereinafter. The bearing 13 is formed by a braid made of fluoride fibers.

In the butt flange 11 constructed as above, the single center pin 14 (pivotal pin) having a predetermined length is mounted to the left and right support walls 12*a* and 12*a*, in a state in which the center pin 14 is inserted in the left and right pin holes 12*b* and 12*b* having the respective two bearings 13 and 13 mounted therein. Further, a portion of the center pin 14 between the left and right support walls 12*a* and 12*a* is fixed by a butt plate screw 23*b* in a state sandwiched between the front lower end of the butt 23 of the hammer assembly 4 and a butt plate 23*a*, whereby the center pin 14 is integrally assembled to the butt 23. With the construction described above, the hammer assembly 4 is pivotally supported by the butt flange 11 via the center pin 14 and the left and right bearings 13 and 13.

As shown in FIG. 1, the wippen 21 is made of a synthetic resin and formed into a predetermined shape. Specifically, the wippen 21 has a heel portion 21*a* protruding downward, and is placed on a capstan button 2*b* provided on the rear end of the associated key 2*a* via the heel portion 21*a*. Further, the wippen 21 has its rear end supported by a wippen flange 15.

Figure 3:
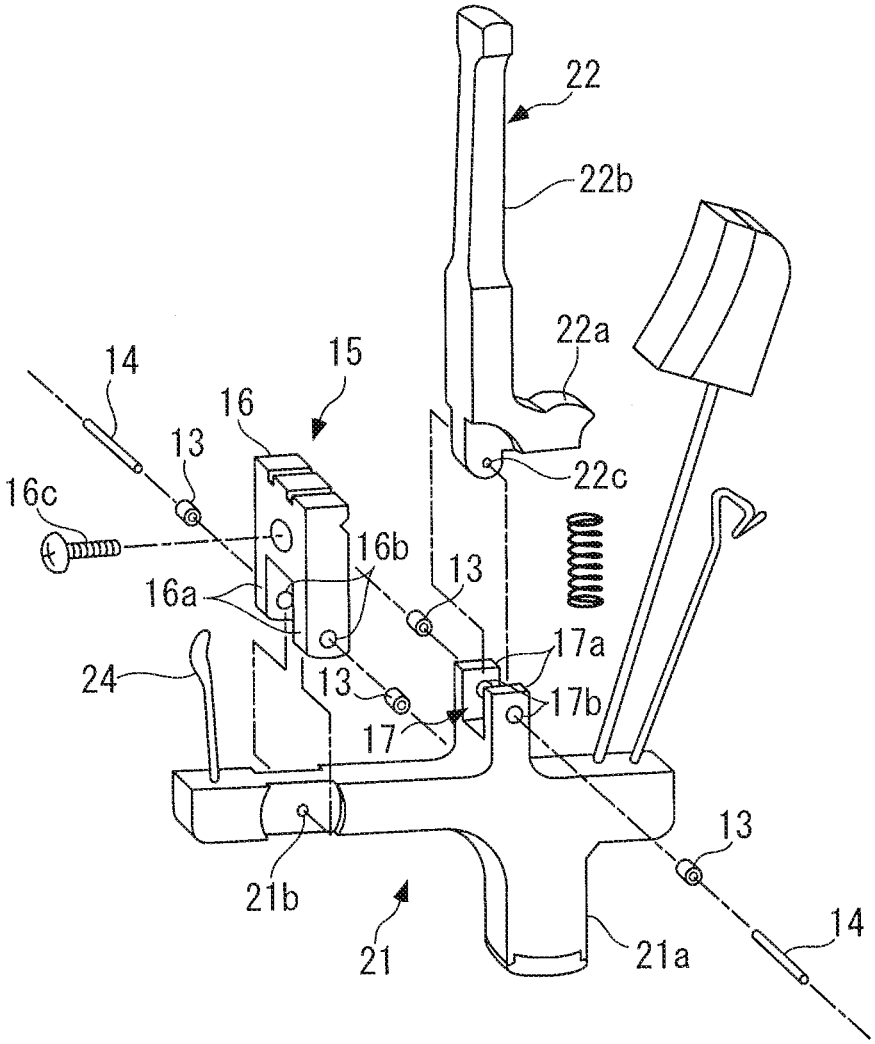
FIG. 3 is an exploded perspective view of a wippen, a jack, a wippen flange, etc. appearing in FIG. 1.

As shown in FIG. 3, the wippen flange 15 is constructed similar to the aforementioned butt flange 11. More specifically, the wippen flange 15 is comprised of a flange body 16 (support device body) made of a synthetic resin and two bearings 13 and 13, and the bearings 13 and 13 are mounted in pin holes 16*b* and 16*b* of respective two support walls 16*a* and 16*a* of the flange body 16. The wippen flange 15 is fastened to the lower end of the rear surface of the center rail 6 by a wippen flange screw 16*c*, in a state in which the two support walls 16*a* and 16*a* extend downward.

The wippen 21 has a rear portion thereof formed with a pin mounting hole 21*b* (hole portion) extending therethrough in the left-right direction, and the wippen 21 and the wippen flange 15 are assembled to each other in a state in which the pin mounting hole 21*b* is positioned between the left and right support walls 16*a* and 16*a* of the wippen flange 15. In this state, the single center pin 14 is inserted through the left and right pin holes 16*b* and 16*b*, and the pin mounting hole 21*b* therebetween. The center pin 14 is integrally assembled to the wippen 21, and the wippen 21 is pivotally supported by the wippen flange 15 via the center pin 14 and the left and right bearings 13 and 13.

Further, at a location close to the center of the wippen 21 in the front-rear direction, a flange part 17 protruding upward is integrally formed with the wippen 21. Similar to the butt flange 11 and the wippen flange 15, the flange part 17 includes left and right support walls 17*a* and 17*a* formed into a bifurcated shape and each formed with a pin hole 17*b*, and bearings 13 and 13 mounted in the respective pin holes 17*b*. The jack 22 is assembled to the flange part 17.

The jack 22 is made of a synthetic resin and formed into an L shape in side view by a root portion 22*a* extending in the front-rear direction and a hammer push-up part 22*b* extending upward from a rear end of the root portion 22*a*. In a corner of the jack 22 formed by the root portion 22*a* and the hammer push-up part 22*b*, there is formed a pin mounting hole 22*c* (hole portion) extending therethrough in the left-right direction, and the wippen 21 and the jack 22 are assembled to each other in a state in which the pin mounting hole 22*c* is positioned between the left and right support walls 17*a* and 17*a* of the flange part 17. In this state, the single center pin 14 is inserted through the left and right pin holes 17*b* and 17*b*, and the pin mounting hole 22*c* therebetween. The center pin 14 is integrally assembled to the jack 22, and the jack 22 is pivotally supported by the flange part 17 via the center pin 14 and the left and right bearings 13 and 13.

Further, as shown in FIG. 1, the center rail 6 is provided with a plurality of regulating brackets 8*a* (only one of which is shown) each extending forward and a regulating rail 8*b* attached to the front ends of the regulating brackets 8*a* and extending in the left-right direction. Attached to the bottom of the regulating rail 8*b* are a plurality of regulating buttons 8*c* (only one of which is shown) in association with the respective keys 2*a*. Further, on the rear end of the wippen 21, there is erected a spoon 24 for driving a damper 25, described hereinafter.

Furthermore, as shown in FIG. 1, a damper flange 18 is attached to the top surface of the center rail 6. The damper flange 18 is constructed similar to the butt flange 11 and the wippen flange 15. More specifically, the damper flange 18 is comprised of a flange body 19 (support device body) made of a synthetic resin and two bearings 13 and 13 (only one of which is shown), and the bearings 13 and 13 are mounted in pin holes 19*b* and 19*b* of respective two support walls 19*a* and 19*a* (only one of which is shown) of the flange body 19. The damper flange 18 is screwed to the center rail 6, in a state in which the two support walls 19*a* and 19*a* extend rearward.

The damper 25 is attached to the damper flange 18. The damper 25 includes a vertically extending damper lever 25*a*, a damper wire 25*b* extending upward from the upper end of the damper lever 25*a*, and a damper head 25*c* attached to the upper end of the damper wire 25*b*. The damper 25 is pivotally supported by the damper flange 18 via a center pin 14 inserted through a pin hole (not shown) formed at a vertical center of the damper lever 25*a*, and the pin holes 19*b* and 19*b* of the respective left and right support walls 19*a* and 19*a* of the flange body 19. The damper head 25*c* is urged rearward by a damper lever spring 25*d*, and is in contact, from the front side, with a string S stretched in a vertically extending manner, when in a key-released state.

Now, a description will be given of sequential operations performed in the above-described upright piano between the start of key depression and the end of the key depression. First, as the key 2*a* is depressed by the player in the key-released state shown in FIG. 1, the key 2*a* pivotally moves about the balance pin 5*a* in the clockwise direction as viewed in FIG. 1, and the wippen 21 placed on the rear end of the key 2*a* is pushed up by the key 2*a*, whereby the wippen 21 is pivotally moved upward (counterclockwise, as viewed in FIG. 1) about the center pin 14 of the wippen flange 15. In accordance with this pivotal motion of the wippen 21, the lower end of the damper lever 25*a* is pressed rearward by the spoon 24, whereby the damper 25 pivotally moves clockwise about the center pin 14 of the damper flange 18. This moves the damper head 25*c* away from the string S.

Further, in accordance with the pivotal motion of the wippen 21 described above, the jack 22 moves upward together with the wippen 21, while the hammer 3 is pushed up by the hammer push-up part 22*b* of the jack 22 via the butt 23 and is thereby pivotally moved counterclockwise about the center pin 14 of the butt flange 11 toward the string S located rearward of the hammer 3.

When the key 2*a* is further pivotally moved by being depressed, the root portion 22*a* of the jack 22 is brought into abutment with the regulating button 8*c* from below. As a consequence, further upward motion of the jack 22 is blocked, and the jack 22 pivotally moves about the center pin 14 of the flange part 17 in the clockwise direction with respect to the wippen 21.

Then, when the key 2*a* further pivotally moves, the hammer push-up part 22*b* of the jack 22 comes forward off the butt 23, whereby the jack 22 is disengaged from the hammer assembly 4. Even after disengagement of the jack 22, the hammer 3 is pivotally moved by inertia, and the hammer head 3*b* collides with the string S and vibrates the same, whereby a piano tone is generated. Thereafter, a repellent force of the string S causes the hammer assembly 4 to perform pivotal return motion in the clockwise direction about the center pin 14 of the butt flange 11.

When the key depression is completed to release the key 2*a*, the key 2*a* is pivotally moved about the balance pin 5*a* to return to its key-released state prior to key depression. At this time, the wippen 21, the jack 22, and the damper 25 of the action 1 each also perform pivotal return motion in an opposite direction to the direction during key depression and return to a key-released state prior before key depression.

Next, a description will be given, with reference to FIGS. 4A to 6C, of a method of manufacturing the butt flange 11, the wippen flange 15, the flange part 17 and the damper flange 18 that pivotally support the hammer assembly 4, the wippen 21, the jack 22, and the damper 25, respectively. In the following description, the hammer assembly 4, the wippen 21, the jack 22, and the damper 25 are generically referred to as "the pivotal member", and the butt flange 11, the wippen flange 15, the flange part 17 and the damper flange 18 are generically referred to as "the flange".

Figure 4A:
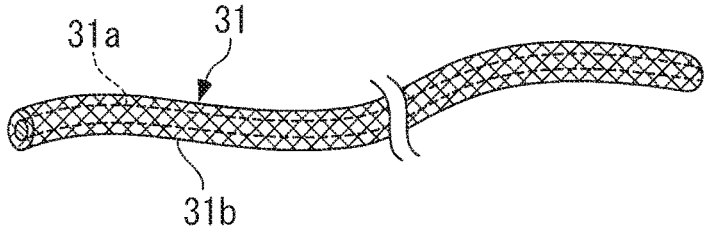
Figure 4B:
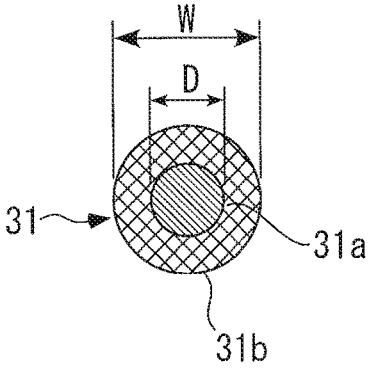

First, a predetermined core material-containing braid for forming bearings of the flange is prepared, and a flange body is also prepared. FIGS. 4A and 4B show the core material-containing braid. This core material-containing braid 31 is comprised of a slender elongated core material 31*a* and a braid 31*b* extending along the length of the core material 31*a* and covering the peripheral surface of the same. The core material 31*a* is made of a synthetic resin and has a predetermined diameter D (e.g. 1 mm), while the braid 31*b* has a predetermined outer diameter W (e.g. 2 mm) and is made of fluoride fibers. Note that the core material-containing braid 31 is formed by knitting a large number of fluoride fibers such that the fluoride fibers obliquely cross each other along the length of the core material 31*a* prepared in advance. This forms the braid 31*b* itself into a hollow cylindrical shape having a hollow extending over the whole length thereof.

Figure 4C:
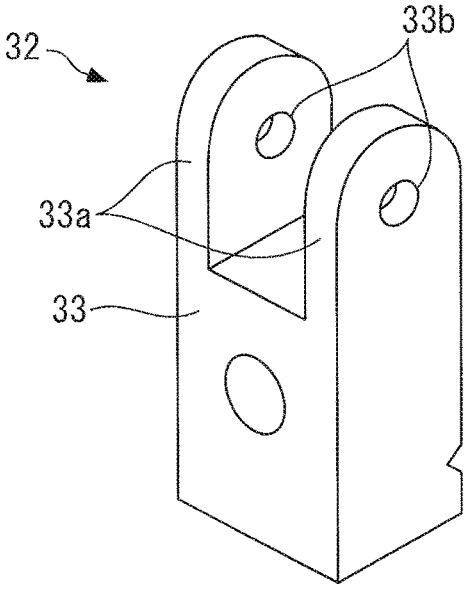

The flange body 33 shown in FIG. 4C has two left and right support walls 33*a* and 33*a* opposed to each other with a predetermined spacing therebetween, and each of the support walls 33*a* has a pin hole 33*b* extending therethrough and having a predetermined diameter (e.g. 2 mm).

Figure 5A:
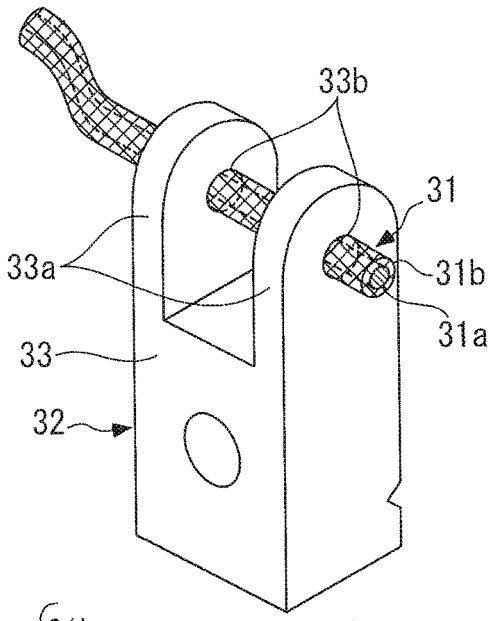

After the core material-containing braid 31 and the flange body 33 constructed as above are prepared, first, the core material-containing braid 31 is inserted through the two pin holes 33*b* and 33*b* of the flange body 33 as shown in FIG. 5A. Note that prior to this, an adhesive is applied in advance to predetermined portions of the surface of the core material-containing braid 31 and/or the inner peripheral surface of each of the pin holes 33*b* and 33*b* of the flange body 33. This causes the core material-containing braid 31 to be fixed to the pin holes 33*b* and 33*b* via portions thereof in contact with the inner peripheral surfaces of the pin holes 33*b* and 33*b*.

Figure 5B:
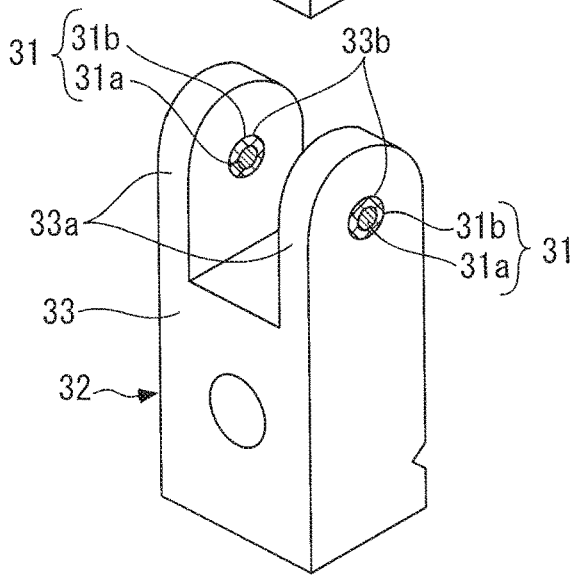
Figure 5C:
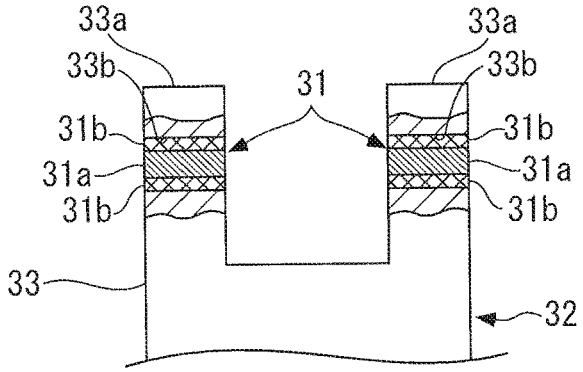

Next, the core material-containing braid 31 is cut by a cutter, not shown, along the outer and inner surfaces of each of the support walls 33*a* such that the cut surfaces thereof become flush with the respective outer and inner surfaces of each of the support walls 33*a*. This mounts the core material-containing braid 31 in each of the two pin holes 33*b* and 33*b* of the flange body 33 in a state filling the associated pin hole 33*b*, as shown in FIGS. 5B and 5C. More specifically, the core material-containing braid 31 is mounted in each of the pin holes 33*b*, in a state in which the core material 31*a* is positioned in the central portion of the associated pin hole 33*b*, and the braid 31*b* is positioned outside the core material 31*a* and bonded to the inner peripheral surface of the associated pin hole 33*b*.

Figure 6A:
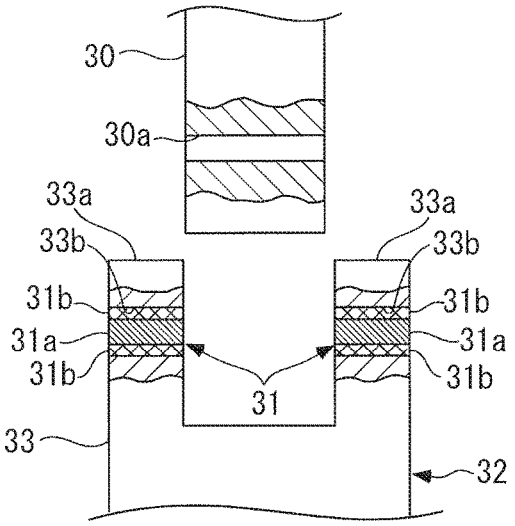
Figure 6B:
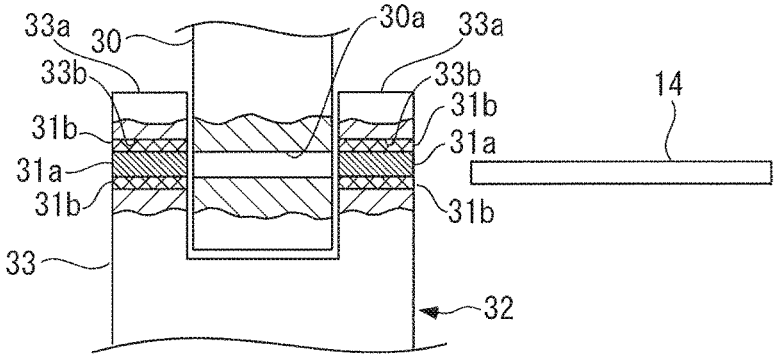
Figure 6C:
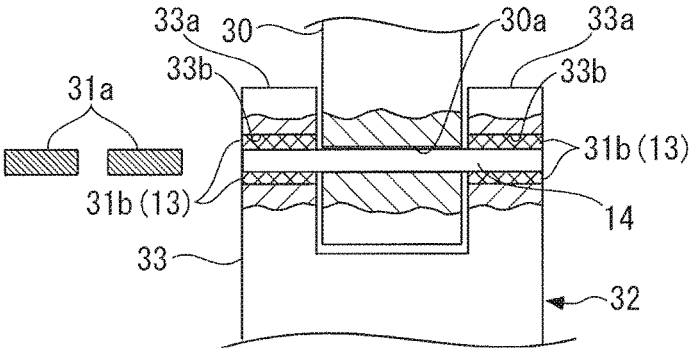
Figure 7A:
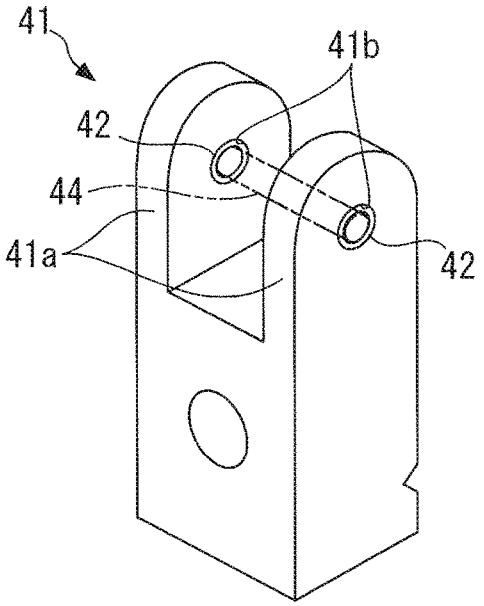
Figure 7B:
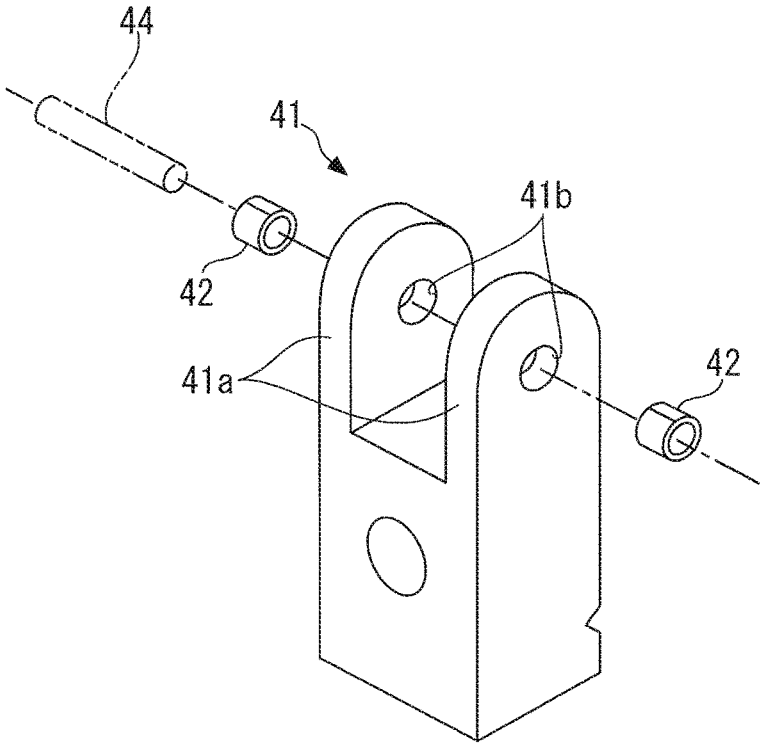
Figure 8A:
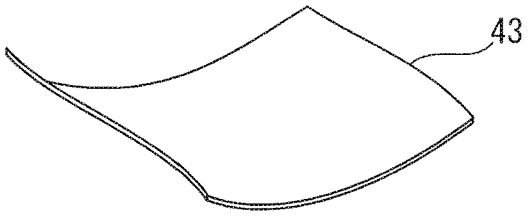
FIGS. 8A to 8D are views useful in explaining a procedure in which the bushing cloths are mounted in the flange.
Figure 8B:
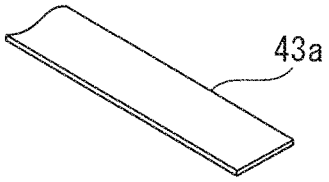
Figure 8C:
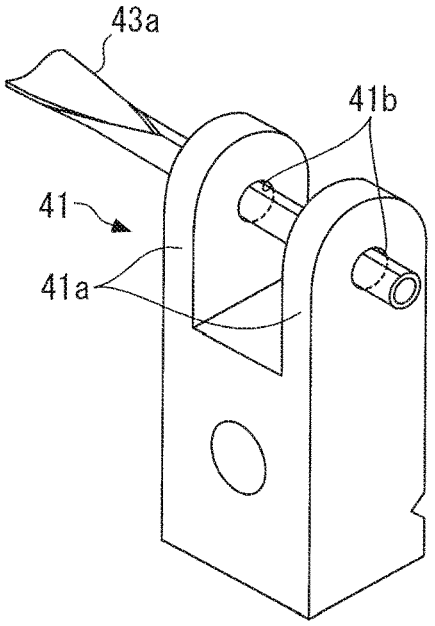
Figure 8D:
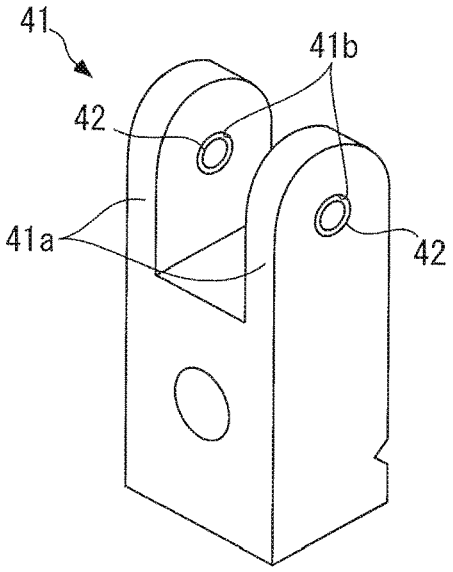
Figure 9A:
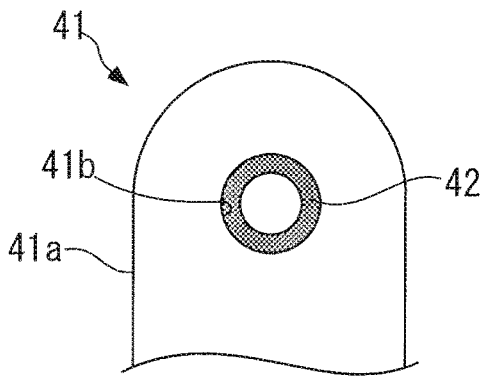
Figure 9B:
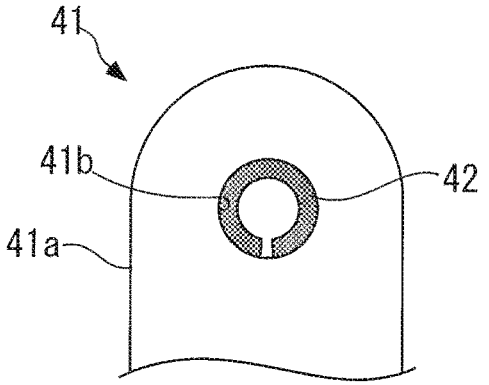
Figure 9C:
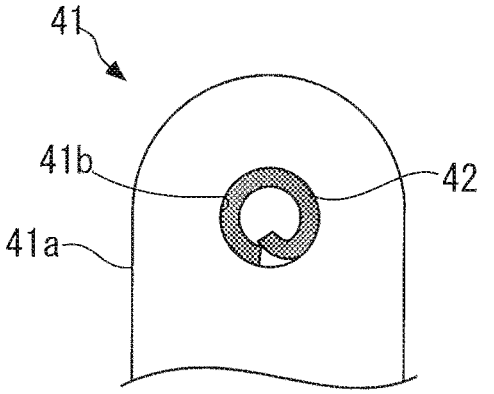

FIGS. 6A to 6C show a procedure in which a pivotal member 30 and a flange 32 are coupled to each other. Note that as shown in FIG. 6A, the pivotal member 30 is formed therethrough with a pin mounting hole 30*a* (hole portion) for mounting the center pin 14 in a state inserted through the pivotal member 30.

First, as shown in FIG. 6B, the pivotal member 30 is mounted between the two support walls 33*a* and 33*a* such that the pin mounting hole 30*a* of the pivotal member 30 and the two pin holes 33*b* and 33*b* of the flange 32 are aligned in a straight line. Then, the center pin 14 is inserted from outside one of the support walls 33*a* into the center of the associated pin hole 33*b*. In doing this, the center pin 14 is inserted, as shown in FIG. 6C, such that the center pin 14 extends through the two support walls 33*b* and 33*b* of the flange 32 and the pivotal member 30, while pushing out the core material 31*a* of the core material-containing braid 31 mounted in each of the two pin holes 33*b* and 33*b*. This causes the center pin 14 to be fixed in a state inserted through the pin mounting hole 30*a* of the pivotal member 30, and the opposite ends of the center pin 14 are pivotally supported by the two support walls 33*a* and 33*a*, respectively, via the respective braids 31*b* and 31*b* as bearings.

As described above in detail, according to the present embodiment, the opposite ends of the center pin 14 fixed to the pivotal member 30, such as the hammer assembly 4, the wippen 21, the jack 22, and the damper 25, are pivotally supported by the associated flange 32 via the respective bearings 13 and 13. Each of the bearings 13 is formed by a cylindrical braid having a hollow therein, and therefore, differently from the related art in which a strip-shaped cloth is rolled up into a bushing cloth, it is possible to position each of the opposite ends of the center pin 14 properly in the center of the associated pin hole 33*b* of the flange 32 and cause the pivotal member 30 to perform efficient and stable pivotal motion. Further, the bearings 13 are formed using the core material-containing braid 31, and the pivotal member 30 and the flange 32 are coupled by the center pin 14 as described hereinabove, and hence it is possible to easily obtain the flange 32 which enables the pivotal member 30 to perform efficient and stable pivotal motion.

It is preferable that the diameter of a pin hole 33*b* that is formed in a flange 32 is set according to the kind of a pivotal member 30 to be supported by the flange 32. For example, when a flange 32 (flange body 33) is to support a pivotal member 30 (e.g. the jack 22) which should have a higher degree of rotatability, the diameter of the pin hole 33*b* in the flange 32 is increased to thereby reduce friction of the bearing 13 (braid 31*b*), which acts on the center pin 14, whereby the degree of rotatability of the pivotal member 30 can be made higher. On the other hand, when a flange 32 is to support a pivotal member 30 (e.g. the wippen 21) which should have a lower degree of rotatability, the diameter of the pin hole 33*b* in the flange 32 is reduced to thereby increase friction of the bearing 13 (braid 31*b*), which acts on the center pin 14, whereby the degree of rotatability of the pivotal member 30 can be made lower. Therefore, even in a case where a core material-containing braid 31 of a single type is used, it is possible to provide a flange 32 suitable for a degree of rotatability demanded of a pivotal member 30.

Note that the present invention is not limited to the above-described embodiment, but can be practiced in various forms. For example, although in the above-described embodiment, the support device of the present invention is applied to the flanges of an upright piano, the present invention is not limited to this, but it may be applied e.g. to flanges for pivotally supporting various pivotal members of a grand piano or any other keyboard instrument, such as an electronic piano.

Further, although the braid 31*b* is made of fluoride fibers, by way of example, this is not limitative, but it is possible to adopt other various materials. Furthermore, the detailed construction of each of the action 1 and the various flanges 11, 15, 17, and 18 is described only by way of example, and therefore these can be changed, as desired, within the scope of the subject matter of the present invention.

What is claimed is:

1. A method of manufacturing a support device for a pivotal member of a keyboard instrument, which pivotally supports the pivotal member pivotally moved by a key depression, via a pivotal pin fixed to the pivotal member, the method comprising:

preparing a core material-containing braid formed by a slender elongated core material and a braid extending along a length of the core material and covering a peripheral surface of the core material;

preparing a support device body including two support walls opposed to each other with a predetermined spacing therebetween, and two pin holes formed in respective support walls and in which opposite ends of the pivotal pin are inserted, respectively;

inserting the prepared core material-containing braid through the two pin holes of the support device body and fixing the core material-containing braid to the support device body;

cutting the core material-containing braid inserted through the two pin holes, along inner and outer surfaces of each of the support walls such that cut surfaces of the core material-containing braid become flushed with respective inner and outer surfaces;

mounting the pivotal member between the two support walls of the support device body such that a hole portion of the pivotal member, through which the pivotal pin is to be inserted, and the pin holes of the two support walls are aligned in a straight line; and inserting the pivotal pin from an outside of one of the two support walls into the pin hole of the one of the two support walls, the hole portion of the pivotal member, and the pin hole of the other of the two support walls to mount the pivotal pin while pushing out the core material of the core material-containing braid from each pin hole, wherein in the preparing core material step, a core material-containing braid of a single type in which the core material and the braid have respective predetermined diameters is prepared, and wherein the support device body has a diameter of the pin holes set according to a desired degree of rotatability of a kind of the pivotal member to be supported thereby.

2. The method according to claim 1, wherein the braid is formed of fluoride fibers.

* * * * *